US012286681B2

(12) United States Patent
Miyamoto et al.

(10) Patent No.: US 12,286,681 B2
(45) Date of Patent: Apr. 29, 2025

(54) HIGH-CARBON HOT-ROLLED STEEL SHEET AND METHOD FOR MANUFACTURING THE SAME

(71) Applicant: JFE Steel Corporation, Tokyo (JP)

(72) Inventors: Yuka Miyamoto, Tokyo (JP); Yasuhiro Sakurai, Tokyo (JP); Yoshihiko Ono, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 881 days.

(21) Appl. No.: 17/425,112

(22) PCT Filed: Jan. 14, 2020

(86) PCT No.: PCT/JP2020/000782
§ 371 (c)(1),
(2) Date: Jul. 22, 2021

(87) PCT Pub. No.: WO2020/158356
PCT Pub. Date: Aug. 6, 2020

(65) Prior Publication Data

US 2022/0106663 A1 Apr. 7, 2022

(30) Foreign Application Priority Data

Jan. 30, 2019 (JP) ..... 2019-013956

(51) Int. Cl.

| | |
|---|---|
| ***C21D 9/46*** | (2006.01) |
| ***C21D 6/00*** | (2006.01) |
| ***C21D 6/04*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/10*** | (2006.01) |
| ***C22C 38/20*** | (2006.01) |
| ***C22C 38/22*** | (2006.01) |
| ***C22C 38/26*** | (2006.01) |
| ***C22C 38/28*** | (2006.01) |
| ***C22C 38/46*** | (2006.01) |
| ***C22C 38/54*** | (2006.01) |

(52) U.S. Cl.
CPC ..... *C21D 9/46* (2013.01); *C21D 6/004* (2013.01); *C21D 6/005* (2013.01); *C21D 6/008* (2013.01); *C21D 8/0205* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/20* (2013.01); *C22C 38/22* (2013.01); *C22C 38/26* (2013.01); *C22C 38/28* (2013.01); *C22C 38/46* (2013.01); *C22C 38/54* (2013.01); *C21D 2211/003* (2013.01); *C21D 2211/005* (2013.01); *C21D 2211/009* (2013.01)

(58) Field of Classification Search
CPC ..... C21D 9/46; C21D 6/004; C21D 6/005; C21D 6/008; C21D 8/0205; C21D 2211/003; C21D 2211/005; C21D 2211/009; C21D 6/002; C21D 8/0263; C21D 8/0226; C21D 8/0273; C22C 38/001; C22C 38/002; C22C 38/008; C22C 38/02; C22C 38/04; C22C 38/06; C22C 38/20; C22C 38/22; C22C 38/26; C22C 38/28; C22C 38/46; C22C 38/54; C22C 38/32; C22C 38/40; C22C 38/60; B21C 47/02
See application file for complete search history.

(56) References Cited

U.S. PATENT DOCUMENTS

| | | | |
|---|---|---|---|
| 2017/0121787 | A1 | 5/2017 | Miyamoto et al. |
| 2018/0135146 | A1 | 5/2018 | Takata et al. |
| 2021/0054477 | A1 | 2/2021 | Miyamoto et al. |

FOREIGN PATENT DOCUMENTS

| | | | |
|---|---|---|---|
| CN | 102348822 | A | 2/2012 |
| CN | 105143488 | A | 12/2015 |
| CN | 107923013 | A | 4/2018 |
| EP | 3000905 | A1 | 3/2016 |
| EP | 3020843 | A1 | 5/2016 |

(Continued)

OTHER PUBLICATIONS

Chinese Office Action with Search Report for Chinese Application No. 202080011343.1, dated Jun. 1, 2022, 10 pages.

(Continued)

*Primary Examiner* — Anthony M Liang
*Assistant Examiner* — Danny N Kang
(74) *Attorney, Agent, or Firm* — Buchanan Ingersoll & Rooney PC

(57) ABSTRACT

A high-carbon hot-rolled steel sheet and a method for manufacturing the steel sheet are provided. The high-carbon hot-rolled steel sheet has a particular chemical composition. The microstructure of the steel sheet includes ferrite, cementite, and pearlite that accounts for 6.5% or less of the entire microstructure by area fraction. The proportion of the number of cementite grains having an equivalent circle diameter of 0.1 μm or less to the total number of cementite grains is 20% or less, the average cementite grain size is 2.5 μm or less, and the cementite accounts for 1.0% or more and less than 3.5% of the entire microstructure by area fraction. The average concentration of solute B in a region extending from a surface layer to a depth of 100 μm is 10 mass ppm or more. The average concentration of N present as AlN in the region is 70 mass ppm or less.

8 Claims, No Drawings

(56) References Cited

FOREIGN PATENT DOCUMENTS

| | | | | |
|---|---|---|---|---|
| EP | 3091097 | B1 | 11/2016 | |
| EP | 3091098 | A1 | 11/2016 | |
| EP | 3305930 | A1 | 4/2018 | |
| JP | 2005344194 | A | 12/2005 | |
| JP | 2006097109 | A | 4/2006 | |
| JP | 4012475 | B2 | 11/2007 | |
| JP | 2009299189 | A | 12/2009 | |
| JP | 2010255066 | A * | 11/2010 | |
| JP | 4782243 | B2 | 9/2011 | |
| JP | 5458649 | B2 | 4/2014 | |
| JP | 2015017283 | A | 1/2015 | |
| JP | 2015017284 | A | 1/2015 | |
| TW | 201538745 | A | 10/2015 | |
| TW | 201837205 | A | 10/2018 | |
| WO | WO-2010106748 | A1 * | 9/2010 | ..... C21D 8/0236 |
| WO | 2015146173 | A1 | 10/2015 | |
| WO | 2016190396 | A1 | 12/2016 | |
| WO | 2019151048 | A1 | 8/2019 | |

OTHER PUBLICATIONS

Chinese Office Action for Chinese Application No. 202080011343.1, dated Mar. 9, 2023 with Concise Statement of Relevance of Office Action, 7 pages.

International Search Report and Written Opinion for International Application No. PCT/JP2020/000782, dated Mar. 31, 2020, 8 pages.

Kinoshiro et al., "Quantitative Analysis for Solid Solution Content of the Microalloy Elements in Steel" Tetsu-to-Hagane (Iron and Steel), vol. 99 (2013) No. 5, p. 362-365. (Abstract Only).

Extended European Search Report for European Application No. 20747978.3, dated Dec. 7, 2021, 9 pages.

Taiwanese Office Action with Search Report for Taiwanese Application No. 109101846, dated Jul. 10, 2020, 4 pages.

Korean Office Action for Korean Application No. 10-2021-7023744, dated Dec. 8, 2022 with Concise Statement of Relevance of Office Action, 7 pages.

* cited by examiner

HIGH-CARBON HOT-ROLLED STEEL SHEET AND METHOD FOR MANUFACTURING THE SAME

CROSS REFERENCE TO RELATED APPLICATIONS

This is the U.S. National Phase application of PCT/JP2020/000782, filed Jan. 14, 2020, which claims priority to Japanese Patent Application No. 2019-013956, filed Jan. 30, 2019, the disclosures of these applications being incorporated herein by reference in their entireties for all purposes.

FIELD OF THE INVENTION

The present invention relates to a high-carbon hot-rolled steel sheet having high cold workability and high hardenability (immersion-quench hardenability and carburizing hardenability) and a method for manufacturing the high-carbon hot-rolled steel sheet.

BACKGROUND OF THE INVENTION

Currently, automotive parts such as transmissions and sheet recliners are often produced by processing hot-rolled steel sheets (high-carbon hot-rolled steel sheets) which are carbon steels for machine structural use specified in JIS G4051 and alloy steels for machine structural use into desired shapes through cold working and then subjecting the resultants to quenching treatment to ensure the desired hardness. Thus, the hot-rolled steel sheets used as materials are required to have high cold workability and high hardenability, and various steel sheets have previously been proposed.

For example, Patent Literature 1 discloses a high-carbon steel sheet for fine blanking. The steel sheet has a chemical composition containing, by wt %, C: 0.15% to 0.9%, Si: 0.4% or less, Mn: 0.3% to 1.0%, P: 0.03% or less, T. Al: 0.10% or less, and one or more of Cr: 1.2% or less, Mo: 0.3% or less, Cu: 0.3% or less, and Ni: 2.0% or less, or Ti: 0.01% to 0.05%, B: 0.0005% to 0.005%, and N: 0.01% or less and has a microstructure in which carbide grains having a spheroidization ratio of 80% or more and an average grain size of 0.4 to 1.0 μm are dispersed in ferrite.

Patent Literature 2 discloses a high-carbon steel sheet with improved workability. The steel sheet has a chemical composition containing, by mass %, C: 0.2% or more, Ti: 0.01% to 0.05%, and B: 0.0003% to 0.005% and has an average carbide grain size of 1.0 μm or less, with the proportion of carbide grains having a grain size of 0.3 μm or less being 20% or less.

Patent Literature 3 discloses a B-alloyed steel that contains, by mass %, C: 0.20% or more and 0.45% or less, Si: 0.05% or more and 0.8% or less, Mn: 0.5% or more and 2.0% or less, P: 0.001% or more and 0.04% or less, S: 0.0001% or more and 0.006% or less, Al: 0.005% or more and 0.1% or less, Ti: 0.005% or more and 0.2% or less, B: 0.001% or more and 0.01% or less, and N: 0.0001% or more and 0.01% or less, and, furthermore, one or more components selected from Cr: 0.05% or more and 0.35% or less, Ni: 0.01% or more and 1.0% or less, Cu: 0.05% or more and 0.5% or less, Mo: 0.01% or more and 1.0% or less, Nb: 0.01% or more and 0.5% or less, V: 0.01% or more and 0.5% or less, Ta: 0.01% or more and 0.5% or less, W: 0.01% or more and 0.5% or less, Sn: 0.003% or more and 0.03% or less, Sb: 0.003% or more and 0.03% or less, and As: 0.003% or more and 0.03% or less.

Patent Literature 4 discloses a steel for machine structural use with improved cold workability and improved low decarbonization properties. The steel has a chemical composition containing, by mass %, C: 0.10% to 1.2%, Si: 0.01% to 2.5%, Mn: 0.1% to 1.5%, P: 0.04% or less, S: 0.0005% to 0.05%, Al: 0.2% or less, Te: 0.0005% to 0.05%, and N: 0.0005% to 0.03%, furthermore, Sb: 0.001% to 0.05%, and, in addition, one or more of Cr: 0.2% to 2.0%, Mo: 0.1% to 1.0%, Ni: 0.3% to 1.5%, Cu: 1.0% or less, and B: 0.005% or less, and has a microstructure composed mainly of ferrite and pearlite, with the ferrite grain size number being 11 or more.

Patent Literature 5 discloses a high-carbon hot-rolled steel sheet with improved hardenability and improved workability. The steel sheet contains, by mass %, C: 0.20% to 0.40%, Si: 0.10% or less, Mn: 0.50% or less, P: 0.03% or less, S: 0.010% or less, sol. Al: 0.10% or less, N: 0.005% or less, and B: 0.0005% to 0.0050%, further contains one or more of Sb, Sn, Bi, Ge, Te, and Se in an amount of 0.002% to 0.03% in total, has a microstructure composed of ferrite and cementite, with the density of cementite in ferrite grains being $0.10/\mu m^2$ or less, and has a hardness of 75 or less in terms of HRB and a total elongation of 38% or more.

Patent Literature 6 discloses a high-carbon hot-rolled steel sheet with improved hardenability and improved workability. The steel sheet contains, by mass %, C: 0.20% to 0.48%, Si: 0.10% or less, Mn: 0.50% or less, P: 0.03% or less, S: 0.010% or less, sol. Al: 0.10% or less, N: 0.005% or less, and B: 0.0005% to 0.0050%, further contains one or more of Sb, Sn, Bi, Ge, Te, and Se in an amount of 0.002% to 0.03% in total, has a microstructure composed of ferrite and cementite, with the density of cementite in ferrite grains being $0.10/\mu m^2$ or less, and has a hardness of 65 or less in terms of HRB and a total elongation of 40% or more.

Patent Literature 7 discloses a high-carbon hot-rolled steel sheet that contains, by mass %, C: 0.20% to 0.40%, Si: 0.10% or less, Mn: 0.50% or less, P: 0.03% or less, S: 0.010% or less, sol. Al: 0.10% or less, N: 0.005% or less, and B: 0.0005% to 0.0050%, further contains one or more of Sb, Sn, Bi, Ge, Te, and Se in an amount of 0.002% to 0.03% in total, with the proportion of the amount of solute B to the B content being 70% or more, has a microstructure composed of ferrite and cementite, with the density of cementite in ferrite grains being $0.08/\mu m^2$ or less, and has a hardness of 73 or less in terms of HRB and a total elongation of 39% or more.

Patent Literature 8 discloses a high-carbon hot-rolled steel sheet that has a composition containing, by mass %, C: 0.15% to 0.37%, Si: 1% or less, Mn: 2.5% or less, P: 0.1% or less, S: 0.03% or less, sol. Al: 0.10% or less, N: 0.0005% to 0.0050%, B: 0.0010% to 0.0050%, and at least one of Sb and Sn in an amount of 0.003% to 0.10% in total and satisfying the relationship $0.50 \leq (14[B])/(10.8[N])$, with the balance being Fe and unavoidable impurities, has a microstructure composed of a ferrite phase and cementite, with the average grain size of the ferrite phase being 10 μm or less, the spheroidization ratio of cementite being 90% or more, and has a total elongation of 37% or more.

PATENT LITERATURE

PTL 1: Japanese Unexamined Patent Application Publication No. 2009-299189

PTL 2: Japanese Unexamined Patent Application Publication No. 2005-344194

PTL 3: Japanese Patent No. 4012475

PTL 4: Japanese Patent No. 4782243

PTL 5: Japanese Unexamined Patent Application Publication No. 2015-017283

PTL 6: Japanese Unexamined Patent Application Publication No. 2015-017284

PTL 7: International Publication No. 2015/146173 PTL 8: Japanese Patent No. 5458649

SUMMARY OF THE INVENTION

The technique described in Patent Literature 1 relates to fine blanking properties, and the influence of the dispersion morphology of carbide on the fine blanking properties and hardenability is described. Specifically, Patent Literature 1 states that a steel sheet with improved fine blanking properties and improved hardenability can be obtained by controlling the average carbide grain size to 0.4 to 1.0 μm and the spheroidization ratio to 80% or more. However, Patent Literature 1 does not discuss cold workability and does not describe carburizing hardenability.

The technique described in Patent Literature 2 focuses on the fact that not only the average carbide grain size but fine carbide grains having a size of 0.3 μm or less have an influence on workability, and Patent Literature 2 states that a steel sheet with improved workability can be obtained by controlling the average carbide grain size to 1.0 μm or less and also controlling the proportion of carbide grains having a size of 0.3 μm or less to 20% or less. However, Patent Literature 2 describes a C content range of 0.20% or more but does not discuss a C content range of less than 0.20%.

According to the technique described in Patent Literature 3, a steel with improved cold workability and improved decarbonization resistance can be obtained by adjusting the chemical composition. However, Patent Literature 3 does not describe immersion-quench hardenability or carburizing hardenability.

According to the technique described in Patent Literature 4, the incorporation of B and one or more components selected from Cr, Ni, Cu, Mo, Nb, V, Ta, W, Sn, Sb, and As and the presence of a predetermined amount of solute B in a surface layer provide a steel that achieves high hardenability. However, Patent Literature 4 specifies the hydrogen concentration in an atmosphere in the annealing step as 95% or more and does not describe whether nitrogen absorption can be suppressed to ensure solute B in an annealing step in a nitrogen atmosphere.

According to the techniques described in Patent Literatures 5 to 7, the incorporation of B and one or more of Sb, Sn, Bi, Ge, Te, and Se in an amount of 0.002% to 0.03% in total is highly effective in preventing nitrogen infiltration, and, for example, even when annealing is performed in a nitrogen atmosphere, nitrogen infiltration is prevented, and a predetermined amount of solute B is maintained, thus enhancing hardenability. However, in each of Patent Literatures 5 to 7, the C content is 0.20% or more.

According to the technique described in Patent Literature 8, a steel that contains C: 0.15% to 0.37%, B, and at least one of Sb and Sn and hence has high hardenability is proposed. However, Patent Literature 8 does not discuss higher hardenability, such as carburizing hardenability.

Aspects of the present invention have been made in view of the foregoing problems, and it is an object according to aspects of the present invention to provide a high-carbon hot-rolled steel sheet having high cold workability and high hardenability (immersion-quench hardenability and carburizing hardenability) and a method for manufacturing the high-carbon hot-rolled steel sheet.

To achieve the above object, the present inventors have conducted intensive studies on the relationship among conditions for the production of a high-carbon hot-rolled steel sheet having a steel chemical composition containing B and one or two selected from Sn and Sb, cold workability, and hardenability (immersion-quench hardenability and carburizing hardenability) and obtained the following findings.

i) When annealing is performed in a nitrogen atmosphere, nitrogen in the atmosphere is infiltrated and concentrated into a steel sheet and binds to B and Al in the steel sheet to form boron nitride and aluminum nitride in a surface layer. This may reduce the amount of solute B in the steel sheet, or the presence of aluminum nitride may decrease the austenite grain size during heating in the austenite range before quenching, thus resulting in insufficient quenching. Thus, in accordance with aspects of the present invention, when annealing is performed in a nitrogen atmosphere, at least one of Sb and Sn is added in a predetermined amount into a steel sheet required to have higher hardenability (high carburizing hardenability). In addition, in the annealing, heating is performed at a predetermined heating rate in a temperature range from 450° C. to 600° C., whereby the amount of nitrogen infiltration from the atmosphere into the steel can be reduced to a predetermined amount. As a result, the above nitrogen infiltration is prevented, and a decrease in the amount of solute B and an increase in aluminum nitride are suppressed, so that higher hardenability (high carburizing hardenability) can be ensured.

ii) The cold workability, and the degree of hardness (hardness) and the total elongation (hereinafter also referred to simply as elongation) of a high-carbon hot-rolled steel sheet before quenching are greatly influenced by cementite grains having an equivalent circle diameter of 0.1 μm or less. When the proportion of the number of cementite grains having an equivalent circle diameter of 0.1 μm or less to the total number of cementite grains is 20% or less, a tensile strength of 420 MPa or less and a total elongation (El) of 37% or more can be achieved.

iii) The degree of hardness (hardness) and the total elongation of a high-carbon hot-rolled steel sheet before quenching are greatly influenced by cementite grains having an equivalent circle diameter of 0.1 μm or less. When the proportion of the number of cementite grains having an equivalent circle diameter of 0.1 μm or less to the total number of cementite grains is 10% or less, a tensile strength of 380 MPa or less and a total elongation (El) of 40% or more can be achieved.

iv) The cold workability and hardenability (immersion-quench hardenability and carburizing hardenability) can be improved as follows: after hot rough rolling, finish rolling is performed at a finishing temperature equal to or higher than an $Ar_3$ transformation temperature, and then cooling is performed to 650° C. to 700° C. at an average cooling rate of 20° C./sec to 100° C./sec; coiling is performed at a coiling temperature of higher than 580° C. and 700° C. or lower, and the coil is cooled to normal temperature to obtain a hot-rolled steel sheet; the hot-rolled steel sheet is then heated between 450° C. and 600° C. at an average heating rate of 15° C./h or more; and annealing that involves holding at an annealing temperature lower than an $Ac_1$ transformation temperature is performed.

v) Alternatively, a desired microstructure can be ensured as follows: after hot rough rolling, finish rolling is performed at a finishing temperature equal to or higher than an $Ar_3$ transformation temperature, and then cooling is performed to 650° C. to 700° C. at an average cooling rate of 20° C./sec to 100° C./sec; coiling is performed at a coiling temperature of higher than 580° C. and 700° C. or lower, and the coil is cooled to normal temperature to obtain a hot-rolled steel sheet; the hot-rolled steel sheet is then heated between 450° C. and 600° C. at an average heating rate of 15° C./h or more; and two-stage annealing that involves holding at a temperature equal to or higher than an $Ac_1$ transformation temperature and equal to or lower than an $Ac_3$ transformation temperature for 0.5 h or more, followed by cooling to a temperature lower than an $Ar_1$ transformation temperature at an average cooling rate of 1° C./h to 20° C./h, and holding at a temperature lower than the $Ar_1$ transformation temperature for 20 h or more is performed.

Aspects of the present invention are based on these findings, and are as follows.

[1] A high-carbon hot-rolled steel sheet has a chemical composition containing, by mass %, C: 0.10% or more and less than 0.20%, Si: 0.8% or less, Mn: 0.10% or more and 0.80% or less, P: 0.03% or less, S: 0.010% or less, sol. Al: 0.10% or less, N: 0.01% or less, Cr: 0.05% or more and 0.50% or less, B: 0.0005% or more and 0.005% or less, and one or two selected from Sb and Sn in an amount of 0.002% or more and 0.1% or less in total, with the balance being Fe and unavoidable impurities. The steel sheet has a microstructure including ferrite, cementite, and pearlite that accounts for 6.5% or less of the entire microstructure by area fraction. Regarding the cementite, the proportion of the number of cementite grains having an equivalent circle diameter of 0.1 μm or less to the total number of cementite grains is 20% or less, the average cementite grain size is 2.5 μm or less, and the cementite accounts for 1.0% or more and less than 3.5% of the entire microstructure by area fraction. The average concentration of solute B in a region extending from a surface layer to a depth of 100 μm is 10 mass ppm or more.

The average concentration of N present as AlN in the region extending from the surface layer to the depth of 100 μm is 70 mass ppm or less.

[2] The high-carbon hot-rolled steel sheet according to [1] has a tensile strength of 420 MPa or less and a total elongation of 37% or more.

[3] In the high-carbon hot-rolled steel sheet according to [1] or [2], the ferrite has an average grain size of 4 to 25 μm.

[4] In the high-carbon hot-rolled steel sheet according to any one of [1] to [3], the chemical composition further contains, by mass %, one or two groups selected from Group A and Group B.

Group A: Ti: 0.06% or less

Group B: one or two or more selected from Nb, Mo, Ta, Ni, Cu, V, and W each in an amount of 0.0005% or more and 0.1% or less

[5] A method for manufacturing the high-carbon hot-rolled steel sheet according to any one of [1] to [4] includes subjecting a steel having the chemical composition to hot rough rolling and then performing finish rolling at a finishing temperature equal to or higher than an $Ar_3$ transformation temperature; then performing cooling to 650° C. to 700° C. at an average cooling rate of 20° C./sec to 100° C./sec; performing coiling at a coiling temperature of higher than 580° C. and 700° C. or lower to obtain a hot-rolled steel sheet; then heating the hot-rolled steel sheet in a temperature range from 450° C. to 600° C. at an average heating rate of 15° C./h or more; and performing annealing that involves holding at an annealing temperature lower than an $Ac_1$ transformation temperature.

[6] A method for manufacturing the high-carbon hot-rolled steel sheet according to any one of [1] to [4] includes subjecting a steel having the chemical composition to hot rough rolling and then performing finish rolling at a finishing temperature equal to or higher than an $Ar_3$ transformation temperature; then performing cooling to 650° C. to 700° C. at an average cooling rate of 20° C./sec to 100° C./sec; performing coiling at a coiling temperature of higher than 580° C. and 700° C. or lower to obtain a hot-rolled steel sheet; then heating the hot-rolled steel sheet in a temperature range from 450° C. to 600° C. at an average heating rate of 15° C./h or more; and performing annealing that involves holding at a temperature equal to or higher than an $Ac_1$ transformation temperature and equal to or lower than an $Ac_3$ transformation temperature for 0.5 h or more, followed by cooling to a temperature lower than an $Ar_1$ transformation temperature at an average cooling rate of 1° C./h to 20° C./h, and holding at a temperature lower than the $Ar_1$ transformation temperature for 20 h or more.

According to aspects of the present invention, a high-carbon hot-rolled steel sheet having high cold workability and high hardenability (immersion-quench hardenability and carburizing hardenability) is provided. The use of the high-carbon hot-rolled steel sheet manufactured according to aspects of the present invention as a material steel sheet required to have cold workability for automotive parts such as sheet recliners, door latches, and driving systems can contribute significantly to the production of automotive parts required to have stable quality, thus producing industrially excellent effects.

DETAILED DESCRIPTION OF EMBODIMENTS OF THE INVENTION

Hereinafter, a high-carbon hot-rolled steel sheet according to aspects of the present invention and a method for manufacturing the high-carbon hot-rolled steel sheet will be described in detail. The present invention is not limited to the following embodiments.

1) Chemical Composition

The chemical composition of the high-carbon hot-rolled steel sheet according to aspects of the present invention and the reason for the limitation will be described. Unless otherwise specified, "%", which is a unit of the content in the following chemical composition, means "mass %".

C: 0.10% or More and Less than 0.20%

C is an element important to provide the strength after quenching. If the C content is less than 0.10%, a desired hardness is not provided by heat treatment after forming, and thus the C content needs to be 0.10% or more. However, a C content of 0.20% or more causes hardening, leading to deterioration of toughness and cold workability. Thus, the C content is 0.10% or more and less than 0.20%. When the steel sheet is used for cold working of a part having a complex shape and difficult to form by pressing, the C content is preferably 0.18% or less, and preferably 0.12% or more, more preferably 0.13% or more.

Si: 0.8% or Less

Si is an element that increases strength through solid-solution strengthening. A higher Si content results in a higher hardness to deteriorate cold workability, and thus the Si content is 0.8% or less, preferably 0.65% or less, more preferably 0.50% or less. To ensure desired softening resistance in the tempering step after quenching, the Si content is preferably 0.10% or more, more preferably 0.2% or more, still more preferably 0.3% or more.

Mn: 0.10% or More and 0.80% or Less

Mn is an element that improves hardenability and increases strength through solid-solution strengthening. If the Mn content is less than 0.10%, both immersion-quench hardenability and carburizing hardenability begin to deteriorate, and thus the Mn content is 0.10% or more. When the inner portion of a thick material or the like is to be reliably quenched, the Mn content is preferably 0.25% or more, more preferably 0.30% or more. If the Mn content exceeds 0.80%, a banded structure due to Mn segregation develops, resulting in an inhomogeneous microstructure, and the steel becomes hard through solid-solution strengthening, resulting in low cold workability. Thus, the Mn content is 0.80% or less. In the case of a material for a part required to have formability, a certain level of cold workability is necessary, and thus the Mn content is preferably 0.65% or less, more preferably 0.55% or less.

P: 0.03% or Less

P is an element that increases strength through solid-solution strengthening. If the P content exceeds 0.03%, grain boundary embrittlement is caused to deteriorate the toughness after quenching. The cold workability is also reduced. Thus, the P content is 0.03% or less. To provide high toughness after quenching, the P content is preferably 0.02% or less. Since P reduces the cold workability and the toughness after quenching, the P content is preferably as low as possible. However, an excessive reduction in P leads to an increase in refining cost, and thus the P content is preferably 0.005% or more, more preferably 0.007% or more.

S: 0.010% or Less

S is an element that needs to be minimized because S forms sulfides and reduces the cold workability and the toughness after quenching of the high-carbon hot-rolled steel sheet. If the S content exceeds 0.010%, the cold workability and the toughness after quenching of the high-carbon hot-rolled steel sheet deteriorate significantly. Thus, the S content is 0.010% or less. To provide high cold workability and high toughness after quenching, the S content is preferably 0.005% or less. Since S reduces the cold workability and the toughness after quenching, the S content is preferably as low as possible. However, an excessive reduction in S leads to an increase in refining cost, and thus the S content is preferably 0.0005% or more.

Sol. Al: 0.10% or Less

If the sol. Al content exceeds 0.10%, AlN is formed during heating in quenching treatment, resulting in excessively fine austenite grains. This promotes the formation of a ferrite phase during cooling to form a microstructure composed of ferrite and martensite, resulting in low hardness after quenching. Thus, the sol. Al content is 0.10% or less, preferably 0.06% or less. sol. Al has a deoxidation effect, and to achieve sufficient deoxidation, the sol. Al content is preferably 0.005% or more.

N: 0.01% or Less

If the N content exceeds 0.01%, the formation of AlN leads to the formation of excessively fine austenite grains during heating in quenching treatment, which promotes the formation of a ferrite phase during cooling, resulting in low hardness after quenching. Thus, the N content is 0.01% or less, preferably 0.0065% or less, more preferably 0.0050% or less. N is an element that forms AlN, Cr-based nitride, and boron nitride and thus moderately inhibits the growth of austenite grains during heating in quenching treatment to improve the toughness after quenching. Thus, the N content is preferably 0.0005% or more, more preferably 0.0010% or more.

Cr: 0.05% or more and 0.50% or less

In accordance with aspects of the present invention, Cr is an important element that enhances hardenability. If the Cr content is less than 0.05%, the effect is not sufficiently produced, and thus the Cr content needs to be 0.05% or more. If the Cr content in the steel is 0%, ferrite is readily formed in a surface layer particularly during carburizing and quenching, and a completely quenched microstructure is not obtained, which may increase the likelihood of a decrease in hardness. Thus, in terms of the importance of hardenability, the Cr content is 0.05% or more, preferably 0.10% or more. If the Cr content exceeds 0.50%, the steel sheet before quenching becomes hard to have impaired cold workability. Thus, the Cr content is 0.50% or less. When a part difficult to form by pressing and requiring high workability is processed, even higher cold workability is required, and thus the Cr content is preferably 0.45% or less, more preferably 0.35% or less.

B: 0.0005% or More and 0.005% or Less

In accordance with aspects of the present invention, B is an important element that enhances hardenability. If the B content is less than 0.0005%, the effect is not sufficiently produced. Thus, the B content needs to be 0.0005% or more, and is preferably 0.0010% or more. If the B content exceeds 0.005%, the recrystallization of austenite after finish rolling is retarded to develop a texture of the hot-rolled steel sheet, resulting in high anisotropy after annealing to increase the likelihood that an earing occurs in drawing. Thus, the B content is 0.005% or less, preferably 0.004% or less.

Total Content of One or Two Selected from Sb and Sn: 0.002% or More and 0.1% or Less Sb and Sn are elements effective in suppressing nitrogen infiltration through the steel sheet surface layer. If the total content of one or more of these elements is less than 0.002%, the effect is not sufficiently produced. Thus, the total content of one or more of these elements is 0.002% or more, more preferably 0.005% or more. If one or more of these elements are contained in an amount of more than 0.1% in total, the nitrogen infiltration prevention effect plateaus. In addition, these elements tend to segregate at grain boundaries, and thus if these elements are contained in an amount of more than 0.1% in total, grain boundary embrittlement may occur due to the excessively high content. Thus, the total content of one or two selected from Sb and Sn is 0.1% or less, preferably 0.03% or less, still more preferably 0.02% or less.

In accordance with aspects of the present invention, since one or two selected from Sb and Sn is contained in an amount of 0.002% or more and 0.1% or less in total, nitrogen infiltration through the steel sheet surface layer is suppressed even when annealing is performed in a nitrogen atmosphere, and an increase in nitrogen concentration in the steel sheet surface layer is suppressed. Thus, according to aspects of the present invention, nitrogen infiltration through the steel sheet surface layer can be suppressed; therefore, even when annealing is performed in a nitrogen atmosphere, the amount of solute B in a region extending from the steel sheet surface layer to a depth of 100 μm after annealing can be appropriately ensured, and the formation of aluminum nitride (AlN) in the region extending from the steel sheet surface layer to the depth of 100 μm can be suppressed to allow austenite grains to grow during heating before quenching. As a result, the formation of ferrite and pearlite can be hindered during cooling, thus providing high hardenability.

In accordance with aspects of the present invention, the balance is Fe and unavoidable impurities.

The above-described essential elements provide the high-carbon hot-rolled steel sheet according to aspects of the present invention with the desired properties. To further improve, for example, hardenability, the high-carbon hot-rolled steel sheet according to aspects of the present invention may optionally contain the following elements.

Ti: 0.06% or Less

Ti is an element effective in enhancing hardenability. When sufficient hardenability is not provided by the incorporation of B alone, the hardenability can be improved by the incorporation of Ti. This effect is not produced when the Ti content is less than 0.005%, and thus if Ti is contained, the Ti content is preferably 0.005% or more, more preferably 0.007% or more. When the Ti content exceeds 0.06%, the steel sheet before quenching becomes hard to have impaired cold workability, and thus if Ti is contained, the Ti content is 0.06% or less, preferably 0.04% or less.

Furthermore, to stabilize the mechanical properties and hardenability according to aspects of the present invention, one or two or more selected from Nb, Mo, Ta, Ni, Cu, V, and W may be added each in a required amount.

Nb: 0.0005% or More and 0.1% or Less

Nb is an element that forms a carbonitride and is effective in preventing exaggerated grain growth during heating before quenching, improving toughness, and improving temper softening resistance. When the Nb content is less than 0.0005%, the effect of addition is not sufficiently produced. Thus, if Nb is contained, the lower limit is preferably 0.0005%, more preferably 0.0010% or more. When the Nb content exceeds 0.1%, the effect of addition plateaus, and, in addition, a niobium carbide increases the tensile strength of the base metal to decrease elongation. Thus, if Nb is contained, the upper limit is preferably 0.1%, more preferably 0.05% or less, still more preferably less than 0.03%.

Mo: 0.0005% or More and 0.1% or Less

Mo is an element effective in improving hardenability and temper softening resistance. When the Mo content is less than 0.0005%, the effect of addition is small. Thus, if Mo is contained, the lower limit is preferably 0.0005%, more preferably 0.0010% or more. When the Mo content exceeds 0.1%, the effect of addition plateaus, and the cost increases. Thus, if Mo is contained, the upper limit is preferably 0.1%, more preferably 0.05% or less, still more preferably less than 0.03%.

Ta: 0.0005% or More and 0.1% or Less

Ta is an element that forms a carbonitride similarly to Nb and is effective in preventing exaggerated grain growth during heating before quenching, preventing coarsening of grains, and improving temper softening resistance. When the Ta content is less than 0.0005%, the effect of addition is small. Thus, if Ta is contained, the lower limit is preferably 0.0005%, more preferably 0.0010% or more. When the Ta content exceeds 0.1%, the effect of addition plateaus, the quenching hardness decreases due to excessive carbide formation, and the cost increases. Thus, if Ta is contained, the upper limit is preferably 0.1%, more preferably 0.05% or less, still more preferably less than 0.03%.

Ni: 0.0005% or More and 0.1% or Less

Ni is an element highly effective in improving toughness and hardenability. When the Ni content is less than 0.0005%, the effect of addition is not produced. Thus, if Ni is contained, the lower limit is preferably 0.0005%, more preferably 0.0010% or more. When the Ni content exceeds 0.1%, the effect of addition plateaus, and, in addition, the cost increases. Thus, if Ni is contained, the upper limit is preferably 0.1%, more preferably 0.05% or less.

Cu: 0.0005% or More and 0.1% or Less

Cu is an element effective in ensuring hardenability. When the Cu content is less than 0.0005%, the effect of addition is not sufficiently produced. Thus, if Cu is contained, the lower limit is preferably 0.0005%, more preferably 0.0010% or more. When the Cu content exceeds 0.1%, flaws are likely to occur during hot rolling, resulting in lower manufacturability, such as lower yields. Thus, if Cu is contained, the upper limit is preferably 0.1%, more preferably 0.05% or less.

V: 0.0005% or More and 0.1% or Less

V is an element that forms a carbonitride similarly to Nb and Ta and is effective in preventing exaggerated grain growth during heating before quenching, improving toughness, and improving temper softening resistance. When the V content is less than 0.0005%, the effect of addition is not sufficiently produced. Thus, if V is contained, the lower limit is preferably 0.0005%, more preferably 0.0010% or more. When the V content exceeds 0.1%, the effect of addition plateaus, and, in addition, the tensile strength of the base metal increases due to carbide formation to decrease elongation. Thus, if V is contained, the upper limit is preferably 0.1%, more preferably 0.05% or less, still more preferably less than 0.03%.

W: 0.0005% or More and 0.1% or Less

W is an element that forms a carbonitride similarly to Nb and V and is effective in preventing exaggerated growth of austenite grains during heating before quenching and improving tempering softening resistance. When the W content is less than 0.0005%, the effect of addition is small. Thus, if W is contained, the lower limit is preferably 0.0005%, more preferably 0.0010% or more. When the W content is more than 0.1%, the effect of addition plateaus, the quench hardness decreases due to excessive carbide formation, and the cost increases. Thus, if W is contained, the upper limit is preferably 0.1%, more preferably 0.05% or less, still more preferably less than 0.03%.

In accordance with aspects of the present invention, when two or more selected from Nb, Mo, Ta, Ni, Cu, V, and W are contained, the total content thereof is preferably 0.0010% or more and 0.1% or less.

2) Microstructure

The reason for the limitation of the microstructure of the high-carbon hot-rolled steel sheet according to aspects of the present invention will be described.

In accordance with aspects of the present invention, the microstructure includes ferrite and cementite. Regarding the cementite, the proportion of the number of cementite grains having an equivalent circle diameter of 0.1 μm or less to the total number of cementite grains is 20% or less, the average cementite grain size is 2.5 μm or less, and the cementite accounts for 1.0% or more and less than 3.5% of the entire microstructure by area fraction. The average concentration of solute B in a region extending from a surface layer to a depth of 100 μm is 10 mass ppm or more. The average concentration of N present as AlN in the region extending from the surface layer to the depth of 100 μm is 70 mass ppm or less. In accordance with aspects of the present invention, the average grain size of the ferrite is preferably 4 to 25 μm, more preferably 5 μm or more.

2-1) Ferrite and Cementite

The microstructure of the high-carbon hot-rolled steel sheet according to aspects of the present invention includes ferrite and cementite. In accordance with aspects of the present invention, the area fraction of the ferrite is preferably 92% or more. A ferrite area fraction of less than 92% may reduce formability, thus making it difficult to perform cold working in the case of a part requiring high workability. Thus, the area fraction of the ferrite is preferably 92% or more, more preferably 94% or more.

In the microstructure of the high-carbon hot-rolled steel sheet according to aspects of the present invention, pearlite may be formed in addition to the ferrite and cementite described above. Pearlite may be contained as long as the area fraction thereof in the entire microstructure is 6.5% or less because pearlite in such an amount does not impair the advantageous effects according to aspects of the present invention.

2-2) Proportion of Number of Cementite Grains Having Equivalent Circle Diameter of 0.1 μm or Less to Total Number of Cementite Grains: 20% or Less If the number of cementite grains having an equivalent circle diameter of 0.1 μm or less is large, the hardness increases through dispersion strengthening to decrease elongation. To provide cold workability, in accordance with aspects of the present invention, the proportion of the number of cementite grains having an equivalent circle diameter of 0.1 μm or less to the total number of cementite grains is 20% or less. This can further achieve a tensile strength of 420 MPa or less and a total elongation (El) of 37% or more.

When the high-carbon hot-rolled steel sheet is used for a difficult-to-form part, high cold workability is required, and in this case, the proportion of the number of cementite grains having an equivalent circle diameter of 0.1 μm or less to the total number of cementite grains is preferably 10% or less. When the proportion the number of cementite grains having an equivalent circle diameter of 0.1 μm or less to the total number of cementite grains is 10% or less, a tensile strength of 380 MPa or less and a total elongation (El) of 40% or more can be achieved. The reason why the proportion of cementite grains having an equivalent circle diameter of 0.1 μm or less is specified is that cementite grains of 0.1 μm or less have a dispersion strengthening ability, and an increase in the number of cementite grains having such a size impairs cold workability.

To suppress exaggerated growth of ferrite grains during annealing, the proportion of the number of cementite grains having an equivalent circle diameter of 0.1 μm or less to the total number of cementite grains is preferably 3% or more.

Cementite grains present before quenching have an equivalent circle diameter of about 0.07 to 3.0 μm. The dispersion state of cementite grains before quenching having an equivalent circle diameter of more than 0.1 μm is not particularly specified in accordance with aspects of the present invention because cementite grains of this size do not affect precipitation strengthening much.

2-3) Average Cementite Grain Size: 2.5 μm or Less

In quenching, the cementite needs to be wholly dissolved to ensure a desired amount of solute C in the ferrite. If the average cementite grain size exceeds 2.5 μm, the cementite cannot be completely dissolved during holding in the austenite range, and thus the average cementite grain size is 2.5 μm or less, more preferably 2.0 μm or less. If the cementite is excessively fine, precipitation strengthening of the cementite reduces cold workability, and thus the average cementite grain size is preferably 0.1 μm or more, more preferably 0.15 μm or more.

In accordance with aspects of the present invention, the term "cementite grain size" refers to an equivalent circle diameter of a cementite grain, and the equivalent circle diameter of a cementite grain is a value obtained by measuring the major axis and the minor axis of the cementite grain and converting them into an equivalent circle diameter. The term "average cementite grain size" refers to a value determined by dividing the sum of equivalent circle diameters of all cementite grains by the total number of cementite grains.

2-4) Proportion (Area Fraction) of Cementite Relative to Entire Microstructure: 1.0% or More and Less than 3.5%

If the area fraction of the cementite in the entire microstructure is less than 1.0%, the strength of the base metal decreases, which may result in insufficient strength in the case of a part used without any heat treatment. Thus, the area fraction of the cementite is 1.0% or more, more preferably 1.5% or more. On the other hand, if the strength of the base metal is increased to decrease, particularly, elongation, the risk of cracking in difficult-to-form parts increases, and thus a certain level of elongation needs to be ensured. To achieve the certain level of elongation, the area fraction is less than 3.5%, more preferably 3.0% or less.

2-5) Average Grain Size of Ferrite: 4 to 25 μm (Suitable Condition)

If the average grain size of the ferrite is less than 4 μm, the strength before cold working may increase to deteriorate press formability, and thus the average grain size of the ferrite is preferably 4 μm or more. If the average grain size of the ferrite exceeds 25 μm, the strength of the base metal may decrease. In the field where the steel sheet is formed into an intended product shape and then used without quenching, the base metal needs to have some degree of strength. Thus, the average grain size of the ferrite is preferably 25 μm or less. The average grain size of the ferrite is more preferably 5 μm or more, still more preferably 6 μm or more, and more preferably 20 μm or less, still more preferably 18 μm or less.

In accordance with aspects of the present invention, the equivalent circle diameter of a cementite grain, the average cementite grain size, the proportion of the cementite to the entire microstructure, the area fraction of the ferrite, the average grain size of the ferrite, etc. described above can be measured by methods described in EXAMPLES described later.

2-6) Average Concentration of Solute B in Region Extending from Surface Layer to Depth of 100 μm: 10 Mass Ppm or More In the high-carbon hot-rolled steel sheet according to aspects of the present invention, to prevent the formation of a quenched microstructure such as pearlite or sorbite, which is likely to be formed in a surface layer portion when the steel sheet is quenched, B in a region (portion) extending from the steel sheet surface layer to a 100 μm position in the thickness direction (surface layer 100 μm portion) needs to be present at an average concentration of 10 mass ppm or more in the form of solute B that is not nitrided or oxidized. Automotive parts that are subjected to quenching treatment for use and required to have wear resistance are required to have surface hardness. To provide a desired surface hardness, it is necessary to form a completely quenched microstructure in the surface layer 100 μm portion after quenching. The average concentration of the solute B is preferably 12 mass ppm or more, more preferably 15 mass ppm or more. An excessively high concentration of the solute B impedes the development of an aggregation texture of hot-rolled microstructures, and thus the average concentration of the solute B is 40 mass ppm or less, more preferably 35 mass ppm or less.

2-7) Average Concentration of N Present as AlN in Region Extending from Surface Layer to Depth of 100 μm: 70 Mass Ppm or Less When the average concentration of N present as AlN in the region extending from the steel sheet surface layer to the 100 μm position in the thickness direction is 70 mass ppm or less, the growth of grains is promoted in the austenite range during heating before quenching. This reduces the likelihood of the formation of a microstructure such as pearlite or sorbite in the cooling stage and provides the desired surface hardness without causing insufficient quenching. The average concentration of N present as AlN in the region extending from the surface layer to the depth of 100 μm is preferably 50 mass ppm or less.

To inhibit the exaggerated grain growth during heating in the austenite range, the average concentration of N is preferably 10 mass ppm or more, more preferably 20 mass ppm or more.

In accordance with aspects of the present invention, it has been found that the amounts of solute B and N present as AlN in the steel sheet surface layer portion are closely related to the manufacturing conditions in each step including heating conditions, coiling conditions, and annealing conditions and that these manufacturing conditions need to be optimized. The reasons necessary for achieving the amounts of solute B and N present as AlN in each step will be described later.

3) Mechanical Properties

The high-carbon hot-rolled steel sheet according to aspects of the present invention is used to form automotive parts such as gears, transmissions, and sheet recliners by cold pressing and thus is required to have high cold workability. In addition, it is necessary to impart wear resistance by increasing the hardness through quenching treatment. Thus, the high-carbon hot-rolled steel sheet according to aspects of the present invention has a reduced tensile strength (TS) of 420 MPa or less and an increased total elongation (El) of 37% or more and hence can achieve both high cold workability and high hardenability (immersion-quench hardenability and carburizing hardenability). More preferably, the TS is 410 MPa or less, and the El is 38% or more.

In the case where the steel sheet is used to form a difficult-to-form part required to have cold pressing properties, the tensile strength of the steel sheet is further reduced to a TS of 380 MPa or less, and the total elongation of the steel sheet is further increased to an El of 40% or more, whereby both high cold workability and high hardenability (immersion-quench hardenability and carburizing hardenability) can be achieved. More preferably, the TS is 370 MPa or less, and the El is 41% or more.

The tensile strength (TS) and the total elongation (El) described above can be measured by methods described in EXAMPLES described later.

4) Manufacturing Method

The high-carbon hot-rolled steel sheet according to aspects of the present invention is manufactured in the following manner using, as a material, a steel having a chemical composition as described above. The material (steel material) is subjected to hot rough rolling, and then finish rolling is performed at a finishing temperature equal to or higher than an $Ar_3$ transformation temperature. Subsequently, cooling is performed to 650° C. to 700° C. at an average cooling rate of 20° C./sec to 100° C./sec. Coiling is performed at a coiling temperature of higher than 580° C. and 700° C. or lower, and the coil is cooled to normal temperature to obtain a hot-rolled steel sheet. The hot-rolled steel sheet is then heated in a temperature range from 450° C. to 600° C. at an average heating rate of 15° C./h or more. Annealing that involves holding at an annealing temperature lower than an $Ac_1$ transformation temperature is performed.

Alternatively, the high-carbon hot-rolled steel sheet according to aspects of the present invention is manufactured in the following manner using, as a material, a steel having a chemical composition as described above. The material (steel material) is subjected to hot rough rolling, and then finish rolling is performed at a finishing temperature equal to or higher than an $Ar_3$ transformation temperature. Subsequently, cooling is performed to 650° C. to 700° C. at an average cooling rate of 20° C./sec to 100° C./sec. Coiling is performed at a coiling temperature of higher than 580° C. and 700° C. or lower, and the coil is cooled to normal temperature to obtain a hot-rolled steel sheet. The hot-rolled steel sheet is then heated in a temperature range from 450° C. to 600° C. at an average heating rate of 15° C./h or more. Two-stage annealing that involves holding at a temperature equal to or higher than an $Ac_1$ transformation temperature and equal to or lower than an $Ac_3$ transformation temperature for 0.5 h or more, followed by cooling to a temperature lower than an $Ar_1$ transformation temperature at an average cooling rate of 1° C./h to 20° C./h, and holding at a temperature lower than the $Ar_1$ transformation temperature for 20 h or more is performed.

Hereinafter, the reason for the limitation in the method for manufacturing the high-carbon hot-rolled steel sheet according to aspects of the present invention will be described. In the description, the expression "° C." regarding temperature indicates a temperature at a steel sheet surface or a surface of a steel material.

In accordance with aspects of the present invention, the steel material may be produced by any method. For example, to prepare a molten high-carbon steel according to aspects of the present invention, either a converter or an electric furnace can be used. The molten high-carbon steel prepared by a known method, for example, using a converter is formed into, for example, a slab (steel material) by ingot making and blooming or continuous casting. Typically, the slab is heated and then subjected to hot rolling (hot rough rolling and finish rolling).

For example, in the case of a slab produced by continuous casting, direct rolling in which the slab is rolled as it is or while being kept hot for the purpose of suppressing temperature drop may be used. When the slab is heated and subjected to hot rolling, the heating temperature of the slab is preferably 1280° C. or lower in order to avoid deterioration of the surface state due to scales. The lower limit of the heating temperature of the slab is preferably 1100° C. or higher, more preferably 1150° C., still more preferably 1200° C. or higher. During the hot rolling, the material to be rolled may be heated by heating means such as a sheet bar heater in order to ensure the finishing temperature.

Finish Rolling at Finishing Temperature Equal to or Higher than $Ar_3$ Transformation Temperature If the finishing temperature is lower than the $Ar_3$ transformation temperature, coarse ferrite grains are formed after the hot rolling and after annealing to significantly decrease elongation. Thus, the finishing temperature is equal to or higher than the $Ar_3$ transformation temperature, preferably equal to or higher than ($Ar_3$ transformation temperature+20° C.). The upper limit of the finishing temperature need not be particularly specified, and is preferably 1000° C. or lower to smoothly perform the cooling after the finish rolling.

The $Ar_3$ transformation temperature described above can be determined by actual measurement such as thermal expansion measurement or electrical resistance measurement during cooling using, for example, Formaster testing.

After Finish Rolling, Cooling to 650° C. to 700° C. at Average Cooling Rate of 20° C./Sec to 100° C./Sec After the finish rolling, the average rate cooling to 650° C. to 700° C. greatly affects the size of spheroidized cementite grains after annealing. If the average cooling rate after the finish rolling is less than 20° C./sec, a microstructure before annealing is composed of an excessive ferrite microstructure and a pearlite microstructure, and thus a desired cementite dispersion state and a desired cementite size are not provided after annealing. Thus, the cooling needs to be performed at 20° C./sec or more. The average cooling rate is preferably 25° C./sec or more. If the average cooling rate exceeds 100° C./sec, cementite grains having a desired size are not readily formed after annealing, and thus the average cooling rate is 100° C./sec or less, preferably 75° C./sec or less.

Coiling Temperature: Higher than 580° C. and 700° C. or Lower

The hot-rolled steel sheet after the finish rolling is wound into a coil shape. If the coiling temperature is excessively high, the hot-rolled steel sheet has excessively low strength and may be deformed by its own weight when wound into a coil shape. This is not preferable from the viewpoint of operation. Thus, the upper limit of the coiling temperature is 700° C., preferably 690° C. or lower. If the coiling temperature is excessively low, the hot-rolled steel sheet disadvantageously becomes hard. Thus, the coiling temperature is higher than 580° C., preferably 600° C. or higher.

After being wound into a coil shape, the coil may be cooled to normal temperature and subjected to pickling treatment. After the pickling treatment, annealing is performed. For the pickling treatment, a known method can be used. Subsequently, the resulting hot-rolled steel sheet is subjected to the following annealing.

Average Heating Rate in Temperature Range from 450° C. to 600° C.: 15° C./h or More The hot-rolled steel sheet obtained as described above is subjected to annealing (spheroidizing annealing of cementite). In the case of annealing in a nitrogen atmosphere, ammonia gas is likely to occur in a temperature range from 450° C. to 600° C., and nitrogen decomposed from the ammonia gas enters the surface of the steel sheet and binds to B and Al in the steel to form nitrides. Thus, the heating time in the temperature range from 450° C. to 600° C. is set to be as short as possible. The average heating rate in this temperature range is 15° C./h or more, preferably 20° C./h or more. To reduce variation in temperature in the furnace for the purpose of improvement in productivity, the average heating rate is preferably 70° C./h or less, more preferably 60° C./h or less.

Holding at Annealing Temperature Lower than $Ac_1$ Transformation Temperature

If the annealing temperature is not lower than the $Ac_1$ transformation temperature, austenite is precipitated, and a coarse pearlite microstructure is formed during the cooling process after the annealing, resulting in an inhomogeneous microstructure. Thus, the annealing temperature is lower than the $Ac_1$ transformation temperature, preferably ($Ac_1$ transformation temperature—10° C.) or lower. The lower limit of the annealing temperature is not particularly specified, and to provide a desired cementite dispersion state, the annealing temperature is preferably 600° C. or higher, more preferably 700° C. or higher. As an atmospheric gas, any of nitrogen, hydrogen, and a gas mixture of nitrogen and hydrogen can be used. The holding time at the annealing temperature is preferably 0.5 to 40 hours. If the holding time at the annealing temperature is less than 0.5 hours, the effect of annealing is slight, and the target microstructure according to aspects of the present invention is not formed, as a result of which the target hardness and elongation of the steel sheet according to aspects of the present invention may not be provided. Thus, the holding time at the annealing temperature is preferably 0.5 hours or more, more preferably 5 hours or more, still more preferably more than 20 hours. If the holding time at the annealing temperature exceeds 40 hours, the productivity decreases, resulting in an excessively high manufacturing cost. Thus, the holding time at the annealing temperature is preferably 40 hours or less, more preferably 35 hours or less.

In accordance with aspects of the present invention, the following two-stage annealing may be performed instead of the above-described annealing. Specifically, the high-carbon hot-rolled steel sheet can also be manufactured as follows: after coiling and cooling to normal temperature are performed, heating is performed in a temperature range from 450° C. to 600° C. at an average heating rate of 15° C./h or more, and two-stage annealing that involves holding at a temperature equal to or higher than the $Ac_1$ transformation temperature and equal to or lower than the $Ac_3$ transformation temperature for 0.5 h or more (first-stage annealing), followed by cooling to a temperature lower than an $Ar_1$ transformation temperature at an average cooling rate of 1° C./h to 20° C./h, and holding at a temperature lower than the $Ar_1$ transformation temperature for 20 h or more (second-stage annealing) is performed.

In accordance with aspects of the present invention, the hot-rolled steel sheet is heated in a temperature range from 450° C. to 600° C. at an average heating rate of 15° C./h or more, held at a temperature equal to or higher than the $Ac_1$ transformation temperature for 0.5 h or more to dissolve relatively fine carbide precipitated in the hot-rolled steel sheet into a γ phase, and then cooled to a temperature lower than the $Ar_1$ transformation temperature at an average cooling rate of 1° C./h to 20° C./h and held at a temperature lower than the $Ar_1$ transformation temperature for 20 h or more. This allows solute C to precipitate with relatively coarse undissolved carbide and the like serving as nuclei to achieve a state in which the dispersion of carbide (cementite) is controlled such that the proportion of the number of cementite grains having an equivalent circle diameter of 0.1 μm or less to the total number of cementite grains is 20% or less. That is to say, in accordance with aspects of the present invention, the dispersion morphology of carbide is controlled by performing the two-stage annealing under the predetermined conditions, whereby the steel sheet is softened. For the softening of the high-carbon steel sheet of interest in accordance with aspects of the present invention, it is important to control the dispersion morphology of carbide after the annealing. In accordance with aspects of the present invention, the high-carbon hot-rolled steel sheet is held at a temperature equal to or higher than the $Ac_1$ transformation temperature and equal to or lower than the $Ac_3$ transformation temperature (first-stage annealing), whereby fine carbide is dissolved, and at the same time, C is dissolved in γ (austenite). In the subsequent cooling to a temperature lower than the $Ar_1$ transformation temperature and holding (second-stage annealing), the α/γ interface and undissolved carbide present in a temperature range of the $Ac_1$ transformation temperature or higher serve as nucleation sites to precipitate relatively coarse carbide. The conditions for the two-stage annealing will be described below. As an atmospheric gas during the annealing, any of nitrogen, hydrogen, and a gas mixture of nitrogen and hydrogen can be used.

Average Heating Rate in Temperature Range from 450° C. to 600° C.: 15° C./h or More For the same reasons as above, ammonia gas is likely to occur in a temperature range from 450° C. to 600° C., and nitrogen decomposed from the ammonia gas enters the surface of the steel sheet and binds to B and Al in the steel to form nitrides. Thus, the heating time in the temperature range from 450° C. to 600° C. is set to be as short as possible. The average heating rate in this temperature range is 15° C./h or more, preferably 20° C./h or more. The upper limit of the average heating rate is preferably 80° C./h, more preferably 70° C./h or less.

Holding at Temperature Equal to or Higher than $Ac_1$ Transformation Temperature and Equal to or Lower than $Ac_3$ Transformation Temperature for 0.5 h or More (First-Stage Annealing)

By heating the hot-rolled steel sheet to an annealing temperature equal to or higher than the $Ac_1$ transformation temperature, part of ferrite in the microstructure of the steel sheet is transformed into austenite, so that fine carbide precipitated in ferrite is dissolved, and C is dissolved in austenite. On the other hand, ferrite remained without being transformed into austenite is annealed at a high temperature, and as a result, the ferrite has a reduced dislocation density and softens. Undissolved relatively coarse carbide (undissolved carbide) remains in ferrite and becomes further coarsened through Ostwald ripening. If the annealing temperature is lower than the $Ac_1$ transformation temperature, austenite transformation does not occur, and thus carbide cannot be dissolved in austenite. If the first-stage annealing temperature is higher than the $Ac_3$ transformation temperature, a large number of rod-like cementite grains are formed after the annealing, and the desired elongation is not provided. Thus, the first-stage annealing temperature is equal to or lower than the $Ac_3$ transformation temperature. In accordance with aspects of the present invention, if the holding time at a temperature equal to or higher than the $Ac_1$ transformation temperature and equal to or lower than the $Ac_3$ transformation temperature is less than 0.5 h, fine carbide cannot be sufficiently dissolved. Thus, in the first-stage annealing, the steel sheet is held at a temperature equal to or higher than the $Ac_1$ transformation temperature and equal to or lower than the $Ac_3$ transformation temperature for 0.5 h or more. The holding time is preferably 1.0 h or more. The holding time is preferably 10 h or less.

Cooling to Temperature Lower than $Ar_1$ Transformation Temperature at Average Cooling Rate of 1° C./h to 20° C./h After the first-stage annealing described above, the steel sheet is cooled to a temperature lower than the $Ar_1$ transformation temperature within the temperature range of the second-stage annealing at an average cooling rate of 1° C./h to 20° C./h. During the cooling, C ejected from austenite as a result of transformation from austenite to ferrite is precipitated in the form of relatively coarse spherical carbide with the $\alpha/\gamma$ interface and undissolved carbide serving as nucleation sites. In this cooling, the cooling rate needs to be adjusted so as not to form pearlite. If the average cooling rate after the first-stage annealing and before the second-stage annealing is less than 1° C./h, the production efficiency is low. Thus, the average cooling rate is 1° C./h or more, preferably 5° C./h or more. If the average cooling rate exceeds 20° C./h, pearlite is precipitated to increase the hardness. Thus, the average cooling rate is 20° C./h or less, preferably 15° C./h or less.

Holding at Temperature Lower than $Ar_1$ Transformation Temperature for 20 h or More (Second-Stage Annealing)

After the first-stage annealing described above, the steel sheet is cooled at a predetermined average cooling rate and held at a temperature lower than the $Ar_1$ transformation temperature to cause Ostwald ripening so that the coarse spherical carbide is further grown and fine carbide disappears. If the holding time at a temperature lower than the $Ar_1$ transformation temperature is less than 20 h, carbide cannot be sufficiently grown, resulting in an excessively high hardness after the annealing. Thus, in the second-stage annealing, the steel sheet is held at a temperature lower than the $Ar_1$ transformation temperature for 20 h or more. For sufficient growth of carbide, the second-stage annealing temperature is preferably, but not necessarily, 660° C. or higher. From the viewpoint of production efficiency, the holding time is preferably, but not necessarily, 30 h or less.

The $Ac_3$ transformation temperature, the $Ac_1$ transformation temperature, the $Ar_3$ transformation temperature, and the $Ar_1$ transformation temperature described above can be determined by actual measurement such as thermal expansion measurement or electrical resistance measurement during heating or cooling using, for example, Formaster testing.

The average heating rates and the average cooling rates described above are determined by measuring temperatures with a thermocouple mounted in the furnace.

EXAMPLES

Molten steels having chemical compositions of steel Nos. A to U shown in Table 1 were cast into slab, and hot rolling was then performed under manufacturing conditions shown in Table 2-1 and Table 3-1. Subsequently, pickling was performed, and annealing (spheroidizing annealing) was performed in a nitrogen atmosphere (atmospheric gas: nitrogen) at annealing temperatures for annealing times (h) shown in Table 2-1 and Table 3-1 to manufacture hot-rolled annealed sheets having a thickness of 3.0 mm.

In Examples of the present invention, test pieces were taken from the hot-rolled annealed sheets thus obtained, and the microstructure, the amount of solute B, the amount of N in AlN, the tensile strength, the total elongation, and the quenching hardness (hardness of steel sheet after quenching and hardness of steel sheet after carburizing and quenching) were determined as described below. The $Ac_3$ transformation temperature, the $Ac_1$ transformation temperature, the $Ar_1$ transformation temperature, and the $Ar_3$ transformation temperature shown in Table 1 were determined by Formaster testing.

(1) Microstructure

The microstructure of each annealed steel sheet was determined as follows: a test piece (size: 3 mm thick×10 mm×10 mm) taken from a central portion in the width direction was cut, polished, and then subjected to nital etching. Images were captured with a scanning electron microscope (SEM) at a magnification of 3000 times at five points at ¼ from a surface layer in the thickness direction. The captured microstructure images were subjected to image processing to identify phases (e.g., ferrite, cementite, and pearlite). In Table 2-2 and Table 3-2, "pearlite area fraction" is shown as a microstructure, and steels observed to have a pearlite area fraction of more than 6.5% are represented as Comparative Examples. Steels including pearlite with an area fraction of 6.5% or less, ferrite, and cementite are represented as Examples.

The SEM images were binarized into ferrite and a non-ferrite region using image analysis software to determine the area fraction (%) of ferrite. Also for cementite, the SEM images were binarized into cementite and a non-cementite region to determine the area fraction (%) of cementite. For pearlite, the area fractions (%) of ferrite and cementite were subtracted from 100(%) to determine the area fraction (%) of pearlite.

In the captured microstructure images, the size of each cementite grain was determined. The cementite grain size was determined by measuring the major axis and the minor axis and converting them into an equivalent circle diameter. The average cementite grain size was determined by dividing the sum of equivalent circle diameters of all cementite grains by the total number of cementite grains. The number of cementite grains whose equivalent circle diameter values were 0.1 μm or less was determined and defined as the number of cementite grains having an equivalent circle diameter of 0.1 μm or less. The number of all cementite grains was determined and defined as the total number of cementite grains. The proportion of the number of cementite grains having an equivalent circle diameter of 0.1 μm or less to the total number of cementite grains ((the number of cementite grains having an equivalent circle diameter of 0.1 μm or less/the total number of cementite grains)×100(%)) was determined. "The proportion of cementite grains having an equivalent circle diameter of 0.1 μm or less" may also be referred to simply as cementite grains having an equivalent circle diameter of 0.1 μm or less.

In the captured microstructure images, the average grain size of ferrite was determined using a method for evaluation of crystal grain size (intercept method) specified in JIS G 0551.

(2) Measurement of Average Concentration of Solute B

The same method as described in the following reference was used. Specifically, ground powder from a region extending from a surface layer to a depth of 100 μm was collected and measured, and the average value (average value of three measurements) was determined as the average concentration of solute B.

[Reference] Satoshi Kinoshiro, Tomoharu Ishida, Kunio Inose, and Kyoko Fujimoto, Tetsu-to-Hagane (Iron and Steel), vol. 99 (2013) No. 5, p. 362-365

(3) Measurement of Average Concentration of N Present as AlN

Similarly to the above, the average concentration of N present as AlN was determined by the same method as described in the following reference.

[Reference] Satoshi Kinoshiro, Tomoharu Ishida, Kunio Inose, and Kyoko Fujimoto, Tetsu-to-Hagane (Iron and Steel), vol. 99 (2013) No. 5, p. 362-365

(4) Tensile Strength and Elongation of Steel Sheet

Using a JIS No. 5 tensile test piece cut out from each annealed steel sheet (original sheet) in a direction at 0° with respect to the rolling direction (L direction), a tensile test was performed at 10 mm/min. A nominal stress-nominal strain curve was determined, and the maximum stress was used as a tensile strength. The broken samples were butted against each other to determine the total elongation. The result was used as an elongation (El).

(5) Hardness of Steel Sheet after Quenching (Immersion-Quench Hardenability)

A flat test piece (15 mm wide×40 mm long×3 mm thick) was taken from a central portion in the width direction of each annealed steel sheet, and subjected to quenching treatment with oil cooling at 70° C. as described below to determine the quenching hardness (immersion-quench hardenability). The quenching treatment was performed in a manner that the flat test piece was held at 900° C. for 600 s and immediately cooled with oil at 70° C. (70° C. oil cooling). The quenching hardness was determined as follows: in a cut surface of the quenching-treated test piece, the hardness was measured in an inner region 70 μm from the surface layer in the width direction and at ¼ from the surface layer in the width direction each at five points with a Vickers hardness tester under a load to 0.2 kgf, and the average hardness was determined as the quenching hardness (HV).

(6) Hardness of Steel Sheet after Carburizing and Quenching (Carburizing Hardenability)

Each annealed steel sheet was subjected to a carburizing and quenching treatment including steel soaking, carburizing treatment, and diffusion treatment at 930° C. for 4 hours in total, held at 850° C. for 30 minutes, and then cooled in oil (oil cooling temperature: 60° C.). The hardness was measured under a load of 1 kgf from a position 0.1 mm deep from the steel sheet surface to a position 1.2 mm deep at intervals of 0.1 mm to determine the hardness (HV) at 0.1 mm from the surface layer and the effective case depth (mm) after carburizing and quenching. The effective case depth is defined as a depth at which the hardness measured from the surface after the heat treatment reaches 550 HV or more.

From the results obtained from the above (5) and (6), the hardenability was evaluated under conditions shown in Table 4. Table 4 presents acceptance criteria of hardenability depending on the C content, in which the hardenability can be evaluated as sufficient. When all of the hardness (HV) after 70° C. oil cooling, the hardness (HV) at 0.1 mm deep from the surface layer after carburizing and quenching, and the effective case depth after carburizing and quenching satisfied the criteria in Table 4, the steel sheet was judged as acceptable (denoted by the symbol ○) and evaluated as having high hardenability. When any of the values did not satisfy the criteria shown in Table 4, the steel sheet was judged as unacceptable (denoted by the symbol x) and evaluated as having poor hardenability.

TABLE 1

| Steel | Chemical composition (mass %) | | | | | | | | | | | | | |
|---|---|---|---|---|---|---|---|---|---|---|---|---|---|---|
| No. | C | Si | Mn | P | S | sol. Al | N | Cr | B | Sb, Sn | Ti | Nb | Mo | Ta |
| A | 0.15 | 0.31 | 0.35 | 0.02 | 0.004 | 0.010 | 0.0044 | 0.15 | 0.0030 | Sb + Sn: 0.010 | — | — | — | — |
| B | 0.14 | 0.25 | 0.30 | 0.01 | 0.003 | 0.005 | 0.0041 | 0.15 | 0.0030 | Sb: 0.010 | — | — | — | — |
| C | 0.15 | 0.79 | 0.35 | 0.02 | 0.004 | 0.010 | 0.0044 | 0.15 | 0.0025 | Sb: 0.030 | — | — | — | — |
| D | 0.14 | 0.64 | 0.40 | 0.02 | 0.004 | 0.010 | 0.0044 | 0.15 | 0.0025 | Sb: 0.015 | — | 0.001 | — | — |
| E | 0.14 | 0.85 | 0.40 | 0.02 | 0.004 | 0.010 | 0.0044 | 0.15 | 0.0025 | Sb: 0.010 | — | 0.001 | — | — |
| F | 0.16 | 0.25 | 0.85 | 0.02 | 0.004 | 0.050 | 0.0050 | 0.10 | 0.0035 | Sb + Sn: 0.010 | — | — | — | — |
| G | 0.15 | 0.30 | 0.40 | 0.01 | 0.003 | 0.006 | 0.0045 | 0.00 | 0.0020 | Sb: 0.015 | — | — | — | — |
| H | 0.14 | 0.20 | 0.35 | 0.01 | 0.003 | 0.010 | 0.0050 | 0.15 | 0.0025 | Sb + Sn: 0.010 | 0.02 | — | — | — |
| I | 0.16 | 0.25 | 0.35 | 0.01 | 0.003 | 0.060 | 0.0050 | 0.52 | 0.0025 | Sb + Sn: 0.010 | 0.02 | — | — | — |
| J | 0.18 | 0.50 | 0.35 | 0.02 | 0.004 | 0.010 | 0.0044 | 0.20 | 0.0020 | Sb: 0.0050 | 0.05 | — | 0.0015 | — |
| K | 0.15 | 0.01 | 0.55 | 0.01 | 0.003 | 0.120 | 0.0110 | 0.50 | 0.0015 | Sb: 0.025 | 0.01 | — | — | — |

TABLE 1-continued

| | | | | | | | | | | | | | | |
|---|---|---|---|---|---|---|---|---|---|---|---|---|---|---|
| L | 0.17 | 0.24 | 0.35 | 0.02 | 0.004 | 0.020 | 0.0044 | 0.15 | 0.0001 | Sb + Sn: 0.012 | — | — | — | — |
| M | 0.15 | 0.30 | 0.45 | 0.02 | 0.004 | 0.040 | 0.0044 | 0.15 | 0.0030 | 0.000 | 0.01 | — | — | — |
| N | 0.19 | 0.01 | 0.04 | 0.02 | 0.003 | 0.050 | 0.0047 | 0.35 | 0.0020 | Sb + Sn: 0.015 | — | — | — | — |
| O | 0.10 | 0.40 | 0.35 | 0.02 | 0.004 | 0.030 | 0.0050 | 0.15 | 0.0019 | Sb + Sn: 0.100 | — | — | — | 0.0020 |
| P | 0.12 | 0.30 | 0.30 | 0.01 | 0.004 | 0.010 | 0.0044 | 0.18 | 0.0025 | Sb: 0.009 | — | — | — | — |
| Q | 0.14 | 0.18 | 0.38 | 0.01 | 0.003 | 0.035 | 0.0052 | 0.15 | 0.0030 | Sb: 0.010 | — | — | — | — |
| R | 0.14 | 0.28 | 0.25 | 0.01 | 0.003 | 0.040 | 0.0047 | 0.20 | 0.0015 | Sb: 0.011 | 0.04 | — | — | 0.0015 |
| S | 0.08 | 0.29 | 0.35 | 0.01 | 0.004 | 0.035 | 0.0050 | 0.13 | 0.0020 | Sb: 0.010 | — | — | — | — |
| T | 0.25 | 0.40 | 0.50 | 0.01 | 0.003 | 0.040 | 0.0050 | 0.45 | 0.0020 | Sb: 0.010 | — | — | — | — |
| U | 0.20 | 0.40 | 0.40 | 0.01 | 0.003 | 0.040 | 0.0040 | 0.10 | 0.0035 | Sb + Sn: 0.015 | 0.04 | — | 0.0013 | — |

| Steel | Chemical composition (mass %) | | | | $Ac_1$ transformation temperature | $Ar_1$ transformation temperature | $Ac_3$ transformation temperature | $Ar_3$ transformation temperature | |
|---|---|---|---|---|---|---|---|---|---|
| No. | Ni | Cu | V | W | (° C.) | (° C.) | (° C.) | (° C.) | Remarks |
| A | — | — | — | — | 731 | 720 | 863 | 851 | Inventive Steel |
| B | — | — | — | — | 730 | 714 | 855 | 844 | Inventive Steel |
| C | — | — | — | — | 745 | 734 | 885 | 873 | Inventive Steel |
| D | — | — | — | — | 740 | 729 | 875 | 867 | Inventive Steel |
| E | — | — | — | — | 746 | 735 | 888 | 876 | Comparative Steel |
| F | — | — | — | — | 723 | 713 | 863 | 847 | Comparative Steel |
| G | — | — | — | — | 727 | 715 | 853 | 842 | Comparative Steel |
| H | — | — | — | — | 728 | 718 | 854 | 842 | Inventive Steel |
| I | — | — | — | — | 735 | 725 | 847 | 855 | Comparative Steel |
| J | — | — | — | — | 737 | 726 | 863 | 852 | Inventive Steel |
| K | — | — | — | — | 726 | 712 | 851 | 865 | Comparative Steel |
| L | — | — | — | — | 729 | 718 | 860 | 847 | Comparative Steel |
| M | — | — | — | — | 729 | 718 | 870 | 860 | Comparative Steel |
| N | — | — | — | — | 729 | 717 | 862 | 851 | Comparative Steel |
| O | — | 0.0015 | — | — | 733 | 723 | 890 | 878 | Inventive Steel |
| P | 0.025 | — | 0.0015 | — | 732 | 722 | 865 | 853 | Inventive Steel |
| Q | — | — | — | 0.0015 | 727 | 716 | 862 | 850 | Inventive Steel |
| R | — | — | — | — | 732 | 720 | 872 | 860 | Inventive Steel |
| S | — | — | — | — | 730 | 715 | 887 | 875 | Comparative Steel |
| T | — | — | — | — | 737 | 722 | 841 | 829 | Comparative Steel |
| U | — | — | — | — | 732 | 720 | 860 | 847 | Comparative Steel |

TABLE 2-1

| | | Hot rolling conditions | | | Annealing conditions | |
|---|---|---|---|---|---|---|
| Sample No. | Steel No. | Finishing temperature (° C.) | Average cooling rate to 650° C. to 700° C. after finish rolling (° C./sec) | Coiling temperature (° C.) | Average heating rate in temperature range from 450° C. to 600° C. (° C./h) | Annealing (annealing temperature-holding time) |
| 1 | A | 880 | 55 | 680 | 40 | 715° C.-30 h |
| 2 | A | 880 | 55 | 560 | 60 | 715° C.-30 h |
| 3 | A | 880 | 50 | 680 | 15 | 715° C.-30 h |
| 4 | B | 865 | 60 | 620 | 30 | 715° C.-30 h |
| 5 | B | 865 | 30 | 620 | 30 | 760° C.-30 h |
| 6 | B | 865 | 60 | 620 | 60 | 715° C.-30 h |
| 7 | B | 865 | 60 | 620 | 5 | 715° C.-30 h |
| 8 | C | 890 | 40 | 620 | 40 | 715° C.-30 h |
| 9 | D | 880 | 60 | 680 | 20 | 710° C.-25 h |
| 10 | E | 880 | 50 | 580 | 20 | 715° C.-30 h |
| 11 | F | 870 | 50 | 620 | 30 | 715° C.-30 h |
| 12 | G | 860 | 50 | 620 | 30 | 715° C.-30 h |
| 13 | H | 865 | 40 | 620 | 50 | 715° C.-30 h |
| 14 | H | 865 | 40 | 620 | 40 | 715° C.-15 h |
| 15 | H | 870 | 45 | 610 | 45 | 710° C.-0.2 h |
| 16 | I | 860 | 50 | 600 | 40 | 715° C.-30 h |
| 17 | J | 860 | 80 | 700 | 20 | 715° C.-30 h |

TABLE 2-1-continued

| Sample No. | Steel No. | Hot rolling conditions: Finishing temperature (° C.) | Average cooling rate to 650° C. to 700° C. after finish rolling (° C./sec) | Coiling temperature (° C.) | Annealing conditions: Average heating rate in temperature range from 450° C. to 600° C. (° C./h) | Annealing (annealing temperature-holding time) |
|---|---|---|---|---|---|---|
| 18 | K | 880 | 60 | 700 | 40 | 715° C.-30 h |
| 19 | L | 860 | 40 | 700 | 50 | 715° C.-30 h |
| 20 | M | 880 | 50 | 680 | 60 | 715° C.-30 h |
| 21 | N | 880 | 50 | 660 | 40 | 715° C.-30 h |
| 22 | O | 900 | 50 | 590 | 40 | 715° C.-30 h |
| 23 | P | 880 | 25 | 610 | 40 | 715° C.-30 h |
| 24 | Q | 870 | 25 | 610 | 30 | 715° C.-30 h |
| 25 | R | 880 | 40 | 700 | 45 | 715° C.-30 h |
| 26 | S | 910 | 40 | 650 | 40 | 715° C.-30 h |
| 27 | T | 890 | 40 | 600 | 40 | 710° C.-25 h |
| 28 | U | 910 | 40 | 600 | 40 | 715° C.-30 h |

TABLE 2-2

| Sample No. | Steel No. | Micro-structure | [(Cementite with equivalent circle diameter of 0.1 μm or less)/(total cementite)] × 100 (%) | Average cementite grain size (μm) | Ferrite average grain size (μm) | Ferrite area fraction (%) | Proportion of cementite to entire microstructure (area %) | Pearlite area fraction (%) | Average concentration of solute B in portion 100 μm from surface layer (mass ppm) | Average concentration of N present as AlN in portion 100 μm from surface layer (mass ppm) |
|---|---|---|---|---|---|---|---|---|---|---|
| 1 | A | ferrite + cementite | 13 | 0.45 | 8 | 96 | 2.4 | 1.6 | 15 | 35 |
| 2 | A | ferrite + cementite | 21 | 0.20 | 6 | 95 | 2.4 | 2.6 | 15 | 35 |
| 3 | A | ferrite + cementite | 13 | 0.40 | 8 | 95 | 2.2 | 2.8 | 12 | 60 |
| 4 | B | ferrite + cementite | 12 | 0.50 | 6 | 96 | 2.0 | 2.0 | 16 | 30 |
| 5 | B | ferrite + cementite + pearlite | 5 | 0.55 | 10 | 83 | 0.5 | 16.5 | 15 | 40 |
| 6 | B | ferrite + cementite | 12 | 0.52 | 6 | 95 | 2.1 | 2.9 | 10 | 70 |
| 7 | B | ferrite + cementite | 13 | 0.51 | 7 | 96 | 2.3 | 1.7 | 9 | 80 |
| 8 | C | ferrite + cementite | 7 | 0.45 | 9 | 95 | 2.4 | 2.6 | 17 | 40 |
| 9 | D | ferrite + cementite | 12 | 0.40 | 8 | 94 | 2.2 | 3.8 | 15 | 30 |
| 10 | E | ferrite + cementite | 13 | 0.35 | 7 | 93 | 2.3 | 4.7 | 14 | 40 |
| 11 | F | ferrite + cementite | 14 | 0.40 | 7 | 91 | 2.7 | 6.3 | 14 | 40 |
| 12 | G | ferrite + cementite | 16 | 0.45 | 10 | 94 | 2.5 | 3.5 | 15 | 40 |
| 13 | H | ferrite + cementite | 12 | 0.38 | 9 | 94 | 2.4 | 3.6 | 15 | 40 |
| 14 | H | ferrite + cementite | 13 | 0.47 | 9 | 95 | 2.3 | 2.7 | 15 | 40 |
| 15 | H | ferrite + cementite + pearlite | 25 | 0.25 | 6 | 85 | 2.5 | 12.5 | 14 | 38 |
| 16 | I | ferrite + cementite | 10 | 0.30 | 8 | 94 | 2.6 | 3.4 | 15 | 35 |
| 17 | J | ferrite + cementite | 15 | 0.38 | 7 | 93 | 3.0 | 4.0 | 16 | 40 |
| 18 | K | ferrite + cementite | 12 | 0.42 | 8 | 94 | 2.2 | 3.8 | 14 | 120 |
| 19 | L | ferrite + cementite | 12 | 0.44 | 8 | 94 | 2.8 | 3.2 | 0 | 70 |
| 20 | M | ferrite + cementite | 12 | 0.41 | 8 | 93 | 2.5 | 4.5 | 5 | 80 |
| 21 | N | ferrite + cementite | 11 | 0.40 | 7 | 94 | 3.1 | 2.9 | 15 | 50 |
| 22 | O | ferrite + cementite | 7 | 0.37 | 8 | 97 | 1.5 | 1.5 | 15 | 40 |
| 23 | P | ferrite + cementite | 9 | 0.49 | 8 | 96 | 1.8 | 2.2 | 17 | 35 |

TABLE 2-2-continued

| | | | | | | | | | | |
|---|---|---|---|---|---|---|---|---|---|---|
| 24 | Q | ferrite + cementite | 8 | 0.51 | 8 | 94 | 2.2 | 3.8 | 16 | 34 |
| 25 | R | ferrite + cementite | 9 | 0.57 | 8 | 95 | 2.2 | 2.8 | 14 | 38 |
| 26 | S | ferrite + cementite | 8 | 0.39 | 7 | 98 | 0.4 | 1.6 | 15 | 40 |
| 27 | T | ferrite + cementite | 25 | 0.42 | 5 | 92 | 3.8 | 4.2 | 15 | 40 |
| 28 | U | ferrite + cementite | 12 | 0.35 | 5 | 93 | 3.6 | 3.4 | 15 | 40 |

| | | | Immersion-quench hardenability (HV) | | Carburizing hardenability | | | |
|---|---|---|---|---|---|---|---|---|
| Sample No. | TS (MPa) | Total elongation (%) | 70° C. oil cooling (surface layer) | 70° C. oil cooling (¼ thickness) | Hardness at 0.1 mm from surface layer after carburizing and quenching (HV) | Effective case depth after carburizing and quenching (mm) | Evaluation of hardenability | Remarks |
| 1 | 400 | 42 | 345 | 370 | 670 | 0.70 | ○ | Example |
| 2 | 430 | 36 | 343 | 365 | 665 | 0.68 | ○ | Comparative Example |
| 3 | 400 | 42 | 340 | 355 | 600 | 0.60 | ○ | Example |
| 4 | 390 | 42 | 335 | 355 | 655 | 0.60 | ○ | Example |
| 5 | 420 | 34 | 340 | 360 | 655 | 0.60 | ○ | Comparative Example |
| 6 | 395 | 42 | 290 | 299 | 600 | 0.40 | ○ | Example |
| 7 | 395 | 41 | 270 | 300 | 580 | 0.40 | x | Comparative Example |
| 8 | 420 | 37 | 355 | 375 | 650 | 0.65 | ○ | Example |
| 9 | 410 | 38 | 355 | 375 | 670 | 0.70 | ○ | Example |
| 10 | 450 | 35 | 360 | 380 | 670 | 0.70 | ○ | Comparative Example |
| 11 | 430 | 36 | 358 | 378 | 700 | 0.80 | ○ | Comparative Example |
| 12 | 400 | 40 | 335 | 370 | 500 | 0.55 | x | Comparative Example |
| 13 | 400 | 41 | 358 | 379 | 700 | 0.70 | ○ | Example |
| 14 | 415 | 37 | 359 | 380 | 700 | 0.70 | ○ | Example |
| 15 | 430 | 35 | 355 | 360 | 700 | 0.65 | ○ | Comparative Example |
| 16 | 430 | 36 | 360 | 380 | 710 | 0.80 | ○ | Comparative Example |
| 17 | 400 | 41 | 370 | 385 | 685 | 0.65 | ○ | Inventive Steel |
| 18 | 420 | 38 | 300 | 380 | 580 | 0.65 | x | Comparative Example |
| 19 | 400 | 40 | 305 | 320 | 550 | 0.45 | x | Comparative Steel |
| 20 | 400 | 41 | 295 | 315 | 560 | 0.45 | x | Comparative Steel |
| 21 | 390 | 43 | 335 | 410 | 590 | 0.50 | x | Comparative Example |
| 22 | 370 | 45 | 333 | 350 | 685 | 0.62 | ○ | Example |
| 23 | 380 | 41 | 345 | 360 | 675 | 0.50 | ○ | Example |
| 24 | 395 | 39 | 345 | 375 | 695 | 0.55 | ○ | Example |
| 25 | 400 | 39 | 350 | 380 | 695 | 0.70 | ○ | Example |
| 26 | 380 | 41 | 280 | 295 | 640 | 0.35 | x | Comparative Example |
| 27 | 440 | 35 | 450 | 455 | 650 | 0.70 | ○ | Comparative Example |
| 28 | 425 | 36 | 440 | 445 | 650 | 0.65 | ○ | Comparative Example |

TABLE 3-1

| Sample No. | Steel No. | Hot rolling conditions: Finishing temperature (° C.) | Average cooling rate to 650° C. to 700° C. after finish rolling (° C./sec) | Coiling temperature (° C.) | Annealing conditions: Average heating rate in temperature range from 450° C. to 600° C. (° C./h) | First-stage annealing (annealing temperature-holding time) | Average cooling rate from first stage to second stage (° C./h) | Second-stage annealing (annealing temperature-holding time) |
|---|---|---|---|---|---|---|---|---|
| 29 | A | 880 | 55 | 680 | 50 | 790° C.-8 h | 10 | 710° C.-30 h |
| 30 | A | 880 | 55 | 680 | 50 | 790° C.-8 h | 10 | 710° C.-15 h |
| 31 | A | 880 | 55 | 680 | 10 | 790° C.-8 h | 10 | 710° C.-30 h |
| 32 | B | 865 | 60 | 620 | 40 | 780° C.-10 h | 12 | 710° C.-20 h |
| 33 | B | 865 | 30 | 620 | 40 | 860° C.-8 h | 10 | 710° C.-30 h |
| 34 | B | 865 | 60 | 670 | 15 | 800° C.-6 h | 50 | 710° C.-30 h |
| 35 | C | 890 | 40 | 620 | 20 | 790° C.-7 h | 12 | 710° C.-25 h |
| 36 | D | 880 | 60 | 680 | 30 | 750° C.-8 h | 10 | 715° C.-20 h |
| 37 | E | 880 | 50 | 580 | 30 | 770° C.-8 h | 10 | 705° C.-30 h |
| 38 | F | 870 | 40 | 600 | 40 | 790° C.-8 h | 10 | 710° C.-30 h |
| 39 | G | 860 | 50 | 620 | 60 | 790° C.-8 h | 10 | 710° C.-30 h |
| 40 | H | 865 | 40 | 620 | 20 | 760° C.-8 h | 10 | 710° C.-25 h |
| 41 | I | 860 | 50 | 600 | 50 | 770° C.-6 h | 10 | 710° C.-30 h |
| 42 | J | 860 | 80 | 700 | 40 | 800° C.-6 h | 10 | 710° C.-25 h |
| 43 | K | 880 | 60 | 700 | 15 | 800° C.-6 h | 10 | 710° C.-25 h |
| 44 | L | 860 | 40 | 700 | 50 | 800° C.-6 h | 10 | 710° C.-25 h |
| 45 | M | 880 | 50 | 680 | 50 | 800° C.-6 h | 10 | 710° C.-20 h |
| 46 | N | 880 | 50 | 660 | 50 | 790° C.-8 h | 15 | 705° C.-30 h |
| 47 | O | 900 | 100 | 650 | 40 | 790° C.-4 h | 8 | 710° C.-25 h |
| 48 | Q | 870 | 40 | 600 | 40 | 770° C.-8 h | 10 | 710° C.-20 h |
| 49 | R | 895 | 50 | 670 | 30 | 800° C.-8 h | 10 | 710° C.-30 h |
| 50 | S | 900 | 50 | 650 | 40 | 810° C.-4 h | 10 | 710° C.-21 h |
| 51 | T | 870 | 40 | 680 | 30 | 800° C.-6 h | 10 | 710° C.-25 h |
| 52 | U | 910 | 40 | 600 | 40 | 800° C.-6 h | 10 | 710° C.-25 h |

TABLE 3-2

| Sample No. | Steel No. | Micro-structure | [(Cementite with equivalent circle diameter of 0.1 μm or less)/(total cementite)] × 100 (%) | Average cementite grain size (μm) | Ferrite average grain size (μm) | Ferrite area fraction (%) | Proportion of cementite to entire microstructure (area %) | Pearlite area fraction (%) | Average concentration of solute B in portion 100 μm from surface layer (mass ppm) | Average concentration of N present as AlN in portion 100 μm from surface layer (mass ppm) |
|---|---|---|---|---|---|---|---|---|---|---|
| 29 | A | ferrite + cementite | 1 | 1.2 | 15 | 96 | 2.2 | 1.8 | 15 | 30 |
| 30 | A | ferrite + cementite + pearlite | 5 | 1.3 | 12 | 85 | 3.0 | 12.0 | 15 | 30 |
| 31 | A | ferrite + cementite | 1 | 1.2 | 15 | 96 | 2.9 | 1.1 | 10 | 80 |
| 32 | B | ferrite + cementite | 1 | 1.4 | 13 | 94 | 2.9 | 3.1 | 17 | 40 |
| 33 | B | ferrite + cementite + pearlite | 5 | 1.2 | 17 | 85 | 2.8 | 12.2 | 13 | 35 |
| 34 | B | ferrite + cementite + pearlite | 3 | 1.1 | 13 | 84 | 2.8 | 13.2 | 14 | 36 |
| 35 | C | ferrite + cementite | 1 | 1.1 | 17 | 95 | 3.0 | 2.0 | 15 | 70 |
| 36 | D | ferrite + cementite | 1 | 2.0 | 15 | 95 | 2.8 | 2.2 | 10 | 50 |
| 37 | E | ferrite + cementite | 1 | 2.0 | 14 | 93 | 2.8 | 4.2 | 16 | 30 |
| 38 | F | ferrite + cementite | 1 | 1.5 | 13 | 94 | 3.2 | 2.8 | 16 | 30 |
| 39 | G | ferrite + cementite | 1 | 1.6 | 15 | 93 | 3.0 | 4.0 | 14 | 30 |
| 40 | H | ferrite + cementite | 1 | 1.5 | 14 | 96 | 2.9 | 1.1 | 15 | 35 |
| 41 | I | ferrite + cementite | 1 | 1.6 | 12 | 94 | 3.2 | 2.8 | 14 | 40 |
| 42 | J | ferrite + cementite | 1 | 1.3 | 14 | 93 | 3.3 | 3.7 | 16 | 35 |
| 43 | K | ferrite + cementite | 1 | 2.0 | 15 | 95 | 3.1 | 1.9 | 14 | 125 |

TABLE 3-2-continued

| | | | | | | | | | | |
|---|---|---|---|---|---|---|---|---|---|---|
| 44 | L | ferrite + cementite | 1 | 1.7 | 13 | 94 | 3.4 | 2.6 | 0 | 70 |
| 45 | M | ferrite + cementite | 1 | 1.6 | 15 | 95 | 3.0 | 2.0 | 5 | 80 |
| 46 | N | ferrite + cementite | 1 | 2.5 | 15 | 93 | 3.3 | 3.7 | 15 | 40 |
| 47 | O | ferrite + cementite | 1 | 2.5 | 15 | 97 | 2.1 | 0.9 | 16 | 30 |
| 48 | Q | ferrite + cementite | 1 | 1.3 | 11 | 94 | 2.9 | 3.1 | 14 | 35 |
| 49 | R | ferrite + cementite | 1 | 1.4 | 13 | 94 | 2.9 | 3.1 | 15 | 40 |
| 50 | S | ferrite + cementite | 1 | 1.4 | 11 | 98 | 0.4 | 1.6 | 14 | 35 |
| 51 | T | ferrite + cementite | 1 | 1.5 | 12 | 94 | 3.8 | 2.2 | 14 | 35 |
| 52 | U | ferrite + cementite | 2 | 1.5 | 12 | 94 | 3.7 | 2.3 | 15 | 40 |

| | | | Immersion-quench hardenability (HV) | | Carburizing hardenability | | | |
|---|---|---|---|---|---|---|---|---|
| Sample No. | TS (MPa) | Total elongation (%) | 70° C. oil cooling (surface layer) | 70° C. oil cooling (¼ thickness) | Hardness at 0.1 mm from surface layer after carburizing and quenching (HV) | Effective case depth after carburizing and quenching (mm) | Evaluation of hardenability | Remarks |
| 29 | 360 | 45 | 347 | 368 | 675 | 0.72 | ○ | Example |
| 30 | 425 | 36 | 350 | 370 | 675 | 0.72 | ○ | Comparative Example |
| 31 | 360 | 45 | 310 | 370 | 590 | 0.50 | x | Comparative Example |
| 32 | 360 | 46 | 335 | 355 | 655 | 0.60 | ○ | Example |
| 33 | 370 | 35 | 342 | 358 | 653 | 0.62 | ○ | Comparative Example |
| 34 | 371 | 35 | 341 | 359 | 655 | 0.61 | ○ | Comparative Example |
| 35 | 380 | 40 | 354 | 374 | 652 | 0.64 | ○ | Example |
| 36 | 375 | 41 | 353 | 376 | 674 | 0.71 | ○ | Example |
| 37 | 430 | 36 | 361 | 379 | 671 | 0.70 | ○ | Comparative Example |
| 38 | 425 | 36 | 359 | 377 | 698 | 0.79 | ○ | Comparative Example |
| 39 | 350 | 46 | 335 | 370 | 500 | 0.55 | x | Comparative Example |
| 40 | 365 | 44 | 362 | 377 | 702 | 0.85 | ○ | Example |
| 41 | 430 | 35 | 360 | 380 | 710 | 0.80 | ○ | Comparative Example |
| 42 | 365 | 45 | 372 | 383 | 680 | 0.62 | ○ | Example |
| 43 | 375 | 42 | 305 | 385 | 585 | 0.63 | x | Comparative Example |
| 44 | 360 | 45 | 303 | 315 | 545 | 0.50 | x | Comparative Example |
| 45 | 400 | 41 | 300 | 320 | 565 | 0.47 | x | Comparative Example |
| 46 | 355 | 47 | 335 | 410 | 590 | 0.50 | x | Comparative Example |
| 47 | 350 | 47 | 340 | 400 | 680 | 0.65 | ○ | Example |
| 48 | 340 | 47 | 345 | 375 | 695 | 0.55 | ○ | Example |
| 49 | 335 | 47 | 335 | 350 | 620 | 0.49 | ○ | Example |
| 50 | 320 | 49 | 280 | 295 | 640 | 0.35 | x | Comparative Example |
| 51 | 430 | 35 | 450 | 455 | 650 | 0.70 | ○ | Comparative Example |
| 52 | 425 | 36 | 440 | 445 | 650 | 0.65 | ○ | Comparative Example |

TABLE 4

| C content | Hardness after 70° C. oil cooling (HV) | Hardness at 0.1 mm deep from surface layer after carburizing and quenching (HV) | Effective case depth after carburizing and quenching (mm) |
|---|---|---|---|
| 0.20% ≤ C | ≥350 | ≥600 | ≥0.60 |
| 0.15% ≤ C < 0.20% | ≥340 | ≥600 | ≥0.60 |
| 0.10% ≤ C < 0.15% | ≥290 | ≥600 | ≥0.40 |
| C < 0.10% | ≥290 | ≥600 | ≥0.40 |

The results in Table 2-2 and Table 3-2 show that the high-carbon hot-rolled steel sheets of Examples each have a microstructure including ferrite and cementite, the proportion of the number of cementite grains having an equivalent circle diameter of 0.1 μm or less to the total number of cementite grains being 20% or less, the average cementite grain size being 2.5 μm or less, the cementite accounting for 1.0% or more and less than 3.5% of the entire microstructure, and have both high cold workability and high hardenability. In addition, the high-carbon hot-rolled steel sheets of Examples were provided with excellent mechanical properties, i.e., a tensile strength of 420 MPa or less and a total elongation (El) of 37% or more.

In contrast, in Comparative Examples outside the scope of the present invention, any one or more of the chemical composition, the microstructure, the amount of solute B, and the amount of N in AlN do not satisfy the scope of the present invention, and as a result, the target performance described above cannot be satisfied in any one or more of the cold workability and the hardenability. In some Comparative Examples, the target properties were not satisfied in one or more of the tensile strength (TS) and the total elongation (El). For example, in Table 2-2 and Table 3-2, Steel S has a C content lower than the range according to aspects of the present invention and thus does not satisfy the immersion-quench hardenability. Steel T has a C content higher than the range according to aspects of the present invention and thus does not satisfy the hardness and total elongation of the steel sheet.

The invention claimed is:

1. A high-carbon hot-rolled steel sheet having a chemical composition comprising, by mass %, C: 0.10% or more and less than 0.20%, Si: 0.8% or less, Mn: 0.10% or more and 0.80% or less, P: 0.03% or less, S: 0.010% or less, sol. Al: 0.10% or less, N: 0.01% or less, Cr: 0.05% or more and 0.50% or less, B: 0.0005% or more and 0.005% or less, and one or two selected from Sb and Sn in an amount of 0.002% or more and 0.1% or less in total, with the balance being Fe and unavoidable impurities, the steel sheet having a microstructure including ferrite, cementite, and pearlite that accounts for 6.5% or less of the entire microstructure by area fraction, wherein regarding the cementite, a proportion of a number of cementite grains having an equivalent circle diameter of 0.1 μm or less to a total number of cementite grains is 20% or less, an average cementite grain size is 2.5 μm or less, and the cementite accounts for 1.0% or more and less than 3.5% of the entire microstructure by area fraction, an average concentration of solute B in a region extending from a surface layer to a depth of 100 μm is 10 mass ppm or more, and an average concentration of N present as AlN in the region extending from the surface layer to the depth of 100 μm is 70 mass ppm or less.

2. The high-carbon hot-rolled steel sheet according to claim 1, having a tensile strength of 420 MPa or less and a total elongation of 37% or more.

3. The high-carbon hot-rolled steel sheet according to claim 1, wherein the ferrite has an average grain size of 4 to 25 μm.

4. The high-carbon hot-rolled steel sheet according to claim 2, wherein the ferrite has an average grain size of 4 to 25 μm.

5. The carbon hot-rolled steel sheet according to claim 1, wherein the chemical composition further comprises, by mass %, one or two groups selected from Group A and Group B:

Group A: Ti: 0.06% or less, and

Group B: one or two or more selected from Nb, Mo, Ta, Ni, Cu, V, and W each in an amount of 0.0005% or more and 0.1% or less.

6. The high-carbon hot-rolled steel sheet according to claim 2, wherein the chemical composition further comprises, by mass %, one or two groups selected from Group A and Group B:

Group A: Ti: 0.06% or less, and

Group B: one or two or more selected from Nb, Mo, Ta, Ni, Cu, V, and W each in an amount of 0.0005% or more and 0.1% or less.

7. The high-carbon hot-rolled steel sheet according to claim 3, wherein the chemical composition further comprises, by mass %, one or two groups selected from Group A and Group B:

Group A: Ti: 0.06% or less, and

Group B: one or two or more selected from Nb, Mo, Ta, Ni, Cu, V, and W each in an amount of 0.0005% or more and 0.1% or less.

8. The high-carbon hot-rolled steel sheet according to claim 4, wherein the chemical composition further comprises, by mass %, one or two groups selected from Group A and Group B:

Group A: Ti: 0.06% or less, and

Group B: one or two or more selected from Nb, Mo, Ta, Ni, Cu, V, and W each in an amount of 0.0005% or more and 0.1% or less.

* * * * *